US005759430A

United States Patent [19]

Tapscott et al.

[11] Patent Number: 5,759,430

[45] Date of Patent: Jun. 2, 1998

[54] CLEAN, TROPODEGRADABLE AGENTS WITH LOW OZONE DEPLETION AND GLOBAL WARMING POTENTIALS TO PROTECT AGAINST FIRES AND EXPLOSIONS

[76] Inventors: Robert E. Tapscott, 3812 Palomas Dr. NE., Albuquerque, N. Mex. 87110; Stephanie R. Skaggs, 11301 Richfield NE., Albuquerque, N. Mex. 87122; Jonathan S. Nimitz, 3300 Mountain Rd. NE., Albuquerque, N. Mex. 87106-1920

[21] Appl. No.: 457,054

[22] Filed: Jun. 1, 1995

(Under 37 CFR 1.47)

Related U.S. Application Data

[60] Division of Ser. No. 236,562, Apr. 29, 1994, abandoned, which is a continuation-in-part of Ser. No. 800,532, Nov. 27, 1991, abandoned.

[51] Int. Cl.[6] ..... A62D 1/08

[52] U.S. Cl. ..... 252/8; 252/2; 252/3; 169/45; 169/46; 169/47

[58] Field of Search ..... 252/2, 3, 8; 169/45, 169/46, 47

[56] References Cited

U.S. PATENT DOCUMENTS

| | | | |
|---|---|---|---|
| 4,487,266 | 12/1984 | Gillis et al. | 169/51 |
| 5,016,715 | 5/1991 | Alasio | 169/61 |
| 5,040,609 | 8/1991 | Dougherty, Jr. et al. | 169/45 |
| 5,124,053 | 6/1992 | Iikubo et al. | 252/8 |
| 5,423,384 | 6/1995 | Galbraith et al. | 169/12 |

OTHER PUBLICATIONS

Technical Report; Defense Technical Information Center (Jul. 1950).

William L. Kopko; Beyond CFCs: . . . refrigerants*; (1990); pp. 79–85.

William M. Pitts et al; Construction of . . . Alternatives; (Aug. 1990); pp. 40–160.

Dictionary of Organic Compounds: Fifth Edition; vol. Five; p. 5477 (1982).

Ronald S. Sheinson et al; The Physical . . . Suppressants; 28 Jul. 1989; pp. 437–450.

Nimitz et al. "Next–Generation High–Efficiency Halon Alternatives", International CFC and Halon Alternatives Conference, Baltimore, MD. (3–5 Dec. 1991), pp. 1–9.

Pitts et al, "Construction of an Exploratory List of Chemicals to Inititate the Search for Halon Alternatives", U.S. Dept. of Commerce, Springfield, VA. (Aug. 1990), pp. i–vii, 54–56.

*Primary Examiner*—Joseph D. Anthony
*Attorney, Agent, or Firm*—Robert W. Becker & Associates

[57] ABSTRACT

A set of tropodegradable agents for extinguishment of fires, suppression of explosions, and inertion against fires and explosions is disclosed. The agents are characterized by high efficiency, cleanliness, and short atmospheric lifetimes. The latter property is essential and results in a low ozone depletion potential (ODP) and a low global warming potential (GWP). The agents are halocarbons or mixtures comprised of halocarbons that have at least one of the following features: carbon-to-carbon double bonds and/or carbon-to-iodine bonds. Specifically disclosed are the two families of agents: (I) bromine-containing alkenes and (2) iodocarbons.

28 Claims, No Drawings

CLEAN, TROPODEGRADABLE AGENTS WITH LOW OZONE DEPLETION AND GLOBAL WARMING POTENTIALS TO PROTECT AGAINST FIRES AND EXPLOSIONS

This application is a division, of application Ser. No. 08/236,562 filed Apr. 29, 1994 now abandoned, which is a continuation-in-part of application, Ser. No. 07/800,532 filed on Nov. 27, 1991 now abandoned.

GOVERNMENT RIGHTS

This invention was made under contract with the U.S. Government, which has certain rights therein.

FIELD OF THE INVENTION

The invention described and claimed herein is generally related to chemical agents used for fire extinguishment, explosion suppression, explosion inertion, and fire inertion and more particularly, to extinguishing, suppressing, and inerting halocarbon agents that are destroyed rapidly by natural processes in the troposphere and thus have short atmospheric lifetimes, low ozone depletion potentials (ODPs), and low global warming potentials (GWPs, also called "greenhouse warming potentials"). Such materials are referred to by us as both "tropodegradable" agents (since they are removed rapidly from the earth's troposphere) and as "second-generation" agents (since they are a new series of chemical agents that offer greatly improved environmental characteristics while maintaining excellent extinguishment, suppression, and inertion properties compared to other agents).

BACKGROUND

The broad class of halocarbons consists of all molecules containing carbon and one or more of the following halogen atoms: fluorine, chlorine, bromine, and/or iodine. Halocarbons may also contain other chemical features such as hydrogen atoms, carbon-to-carbon multiple bonds, or aromatic rings. Haloalkanes, a subset of halocarbons, contain only single bonds between the carbon atoms. Haloalkenes, another subset of halocarbons, contain at least one carbon-to-carbon double bond.

The use of certain haloalkanes as fire extinguishing agents has been known for many years. For example, fire extinguishers containing carbon tetrachloride and methyl bromide were used in aircraft applications as early as the 1920s. Over a period of years the high toxicity of these compounds was recognized and they were replaced with less toxic compounds. Chlorobromomethane was used in aircraft applications from the 1950s to the 1970s. A major study of haloalkanes as fire extinguishing agents was conducted by the Purdue Research Foundation for the U.S. Army from 1947 to 1950. Haloalkanes used for fire protection are often designated by the "halon numbering system," which was devised by the U.S. Army Corps of Engineers. This system gives in order the number of atoms of carbon, fluorine, chlorine, and bromine in the molecule. Thus, for example, $CBrClF_2$, whose chemical name is bromochlorodifluoromethane, is often referred to as Halon 1211.

The term "extinguishment" is usually used to denote complete elimination of a fire; whereas, "suppression" is often used to denote reduction, but not necessarily total elimination, of a fire or explosion. These two terms are sometimes used interchangeably. There are four general types of halocarbon fire and explosion protection applications. (1) In total-flood fire extinguishment and/or suppression applications, the agent is discharged into a space to achieve a concentration sufficient to extinguish or suppress an existing fire. This is often, though not always, done by an automatic system, which detects the fire and then automatically discharges the extinguishing agent to fill the space with the concentration of a gaseous or an evaporated volatile liquid agent to the concentration needed to suppress or extinguish the contained fire. Total flooding use includes protection of enclosed, potentially occupied spaces such, as computer rooms as well as specialized, often unoccupied spaces such as aircraft engine nacelles and engine compartments in vehicles. Note that the term "total flood" does not necessarily mean that the extinguishing or suppressing agent is uniformly dispersed throughout the space protected. (2) In streaming applications, the agent is applied directly onto a fire or into the region of a fire. This is usually accomplished using manually operated wheeled or portable units. A second method, which we have chosen to include as a streaming application, uses a "localized" system, which discharges agent toward a fire from one or more fixed nozzles. Localized systems may be activated either manually or automatically. (3) In explosion suppression, a halocarbon is discharged to suppress an explosion that has already been initiated. The term "suppression" is normally used in this application since the explosion is usually self-limiting. However, the use of this term does not necessarily imply that the explosion is not extinguished by the agent. In this application, a detector is usually used to detect an expanding fireball from an explosion, and the agent is discharged rapidly to suppress the explosion. Explosion suppression is used primarily, but not solely, in defense applications. (4) In inertion, a halocarbon is discharged into a space to prevent an explosion or a fire from being initiated. Often, a system similar or identical to that used for total-flood fire extinguishment or suppression is used. Inertion is widely used for protection of oil production facilities at the North Slope of Alaska and in other areas where flammable gases may build up. Usually, the presence of a dangerous condition (for example, dangerous concentrations of flammable or explosive gases) is detected, and the halocarbon is then discharged to prevent the explosion or fire from occurring until the condition can be remedied.

Thus, there are four fire and explosion protection applications covered by this disclosure:

1. Total-Flood Fire Extinguishment and Suppression
2. Streaming Fire Extinguishment and Suppression
3. Explosion Suppression
4. Explosion and Fire Inertion The halogenated chemical agents currently in use for fire extinguishment (by total flooding or streaming), explosion suppression, explosion inertion, and fire inertion are generally bromine-containing haloalkanes. Such chemicals contain bromine, fluorine, and carbon (and, in at least one case, chlorine), contain no hydrogen atoms, and have only single bonds between atoms. These chemicals include Halon 1202 ($CBr_2F_2$), Halon 1211 ($CBrClF_2$), Halon 1301 ($CBrF_3$), and Halon 2402 ($CBr_2CBrF_2$). We refer to these compounds as the "existing halons." Information on the most important of the existing halons are shown in Table 1. (In this table, the "CAS No." is the number assigned by the Chemical Abstract Services of the American Chemical Society to aid in identifying chemical compounds.) Halon 1301 (bromotrifluoromethane) and Halon 1211

(bromochlorodifluoromethane) are the most widely used haloalkane fire extinguishing agents. Halon 1301 is widely used for total-flood fire extinguishment, explosion suppression, and inertion. Due to its higher boiling point and higher toxicity, Halon 1211 is usually not used in total-flood applications, but, it is widely used in streaming.

TABLE I

EXISTING HALONS.

| Name | Formula | Halon No. | CAS No. | Boiling Point (°C.) | Estimated Lifetime (years) |
|---|---|---|---|---|---|
| dibromodifluoromethane | $CBr_2F_2$ | 1202 | 75-61-6 | 24.5 | 0.6 |
| bromochlorodifluoromethane | $CBrClF_2$ | 1211 | 353-59-3 | −4 | 10 |
| bromotrifluoromethane | $CBrF_3$ | 1301 | 75-63-8 | −58 | 111 |
| 1,2-dibromotetrafluoroethane | $CBrF_2CBrF_2$ | 2402 | 124-73-2 | 47 | 13 |

Bromine-containing haloalkanes such as the existing halons operate as fire extinguishing agents by a complex chemical reaction mechanism involving the disruption of free-radical chain reactions, which are essential for continuing combustion. The existing halons are desirable as fire extinguishing agents because they are effective, because they leave no residue (i.e., they are liquids that evaporate completely or they are gases), and because they do not damage equipment or facilities to which they are applied.

Recently, however, halons, like many other halocarbons, have come to be recognized as serious environmental threats due to their ability to cause stratospheric ozone depletion and global warming. The ozone depletion and global warming impact of chemicals such as these is measured by their ozone depletion potential (ODP) and global warming potential (GWP). ODP and GWP give the relative ability of a chemical to deplete stratospheric ozone or to cause global warming on a per-pound-released basis. ODP and GWP are usually calculated relative to a reference compound (usually trichlorofluoromethane, $CCl_3F$, sometimes referred to as "CFC-11") and are usually calculated based on a release at the earth's surface. It is important to note that ODP and GWP values must be calculated by computer models; they cannot be measured. As models, theory, and input parameters change, the calculated values vary. For that reason, many different values of ODP and GWP are often found in the literature for the same compound. Nevertheless, the calculation results are very accurate in predicting which compounds are highly detrimental to ozone depletion or global warming, which are only moderately detrimental, and which have very low or essentially zero impacts.

When released to the atmosphere, only a small fraction of molecules of the existing halons are destroyed or removed by natural processes in the troposphere. As a result, they have long atmospheric lifetimes. Table I contains the estimated lifetimes of the existing halons as calculated at Lawrence Livermore National Laboratories using a 1-dimensional, non-temperature dependent model. Like ODP and GWP, atmospheric lifetimes will vary depending on the exact model used. The lifetimes of the existing halons are sufficiently long that they are believed to significantly contribute to global warming. For example, the GWP of Halon 1211 (bromochlorodifluoromethane, $CBrClF_2$) is believed to be approximately 0.8 (i.e., about 80 percent that of the reference compound CFC-11). More important, the lifetimes of the existing halons are sufficiently long that they can migrate to the stratosphere where they are photolyzed, leading to formation of bromine (and, in at least one case, chlorine) radicals that are believed to cause depletion of the earth's protective stratospheric ozone layer. Existing halons have ODPs ranging from approximately 3 to 10, that is they are approximately three to ten times more damaging to stratospheric ozone than is the reference compound CFC-11. Again, these numbers may vary. For example, ODP values from 10 to 16 have been reported for Halon 1301. The stratospheric ozone depletion problem is considered sufficiently serious that the 1987 Montreal Protocol includes international restrictions on the productions of many volatile halogenated alkanes. In the United States, production of the existing halons (Halon 1201, Halon 1301, Halon 1211, and Halon 2402) stopped at the end of 1993.

Much research has gone on to find replacements for the existing halons for protection against fires and explosions. Among the properties required for halon replacements, four are of particular importance here: effectiveness, volatility (e.g., cleanliness), low ODP, and low GWP. Although it is relatively easy to identify chemicals having one, two, or three of these properties, it is very difficult to identify chemicals that possess simultaneously all of these properties. Most of the agents now being promoted as halon replacements are hydrochlorofluorocarbons (HCFCs), hydrofluorocarbons (HFCs), and perfluorocarbons (FCs or PFCs). HCFCs, HFCs, and FCs (PFCs) appear to operate almost entirely by heat absorption, which is a less effective mechanism for most fire and explosion protection applications than the free radical chain disruption mechanism used by the existing halons. Thus, HCFCs, HFCs, and FCs (a family that we refer to as "first-generation" halon replacements) have a significantly decreased effectiveness compared to the halons now used for fire and explosion protection in most applications. Moreover, the HCFCs have a sufficiently large ODP that their production is restricted and will eventually be phased out under both the Montreal Protocol and the U.S. Clean Air Act. Finally, the HFCs and, in particular, the FCs have significant atmospheric lifetimes (usually on the order of years or even hundreds of years) and are believed to cause global warming. This may cause eventual restrictions on the HFCs and FCs.

We believe that in order to have fire and explosion protection abilities equal to those of the existing halons for most applications, halocarbons must contain bromine and/or iodine. The presence of bromine and/or iodine is believed necessary in order for a halocarbon to exhibit significant free radical chain disruption. However, once in the stratosphere, bromine (and probably iodine) compounds can cause serious depletion of ozone. One way to accomplish a low ODP is through agents that are destroyed or removed rapidly in the troposphere. Such compounds would not reach the stratosphere, or would reach it only in very small amounts. We refer to such compounds as "tropodegradable." The advantage of tropodegradable compounds with short atmospheric lifetimes is that they would not only have a low ODP, but would also have a low GWP.

Thus, we looked at the major mechanisms for removal of bromine-containing and iodine-containing compounds. The three major mechanisms for destruction of halocarbons in the troposphere are photolysis, attack by hydroxyl (OH) radicals, and attack by oxygen atoms (O). The sunlight reaching the troposphere has a longer wavelength (and a correspondingly lower energy) than that reaching the stratosphere. If molecules are to be photolyzed in the troposphere they must contain chromophoric (light absorbing) groups, weak bonds, or both. Chromophoric groups include carbon-to-carbon multiple bonds (giving compounds that include the alkenes and aromatics) and carbon-to-iodine single bonds ("iodides"). The latter type of chemical bonds are also weak compared to other carbon-halogen bonds. Carbon-to-carbon multiple bonds also react rapidly with naturally-occurring OH radicals found in the troposphere.

Thus, pursuant to the present invention, the following two groups of (compounds having short tropospheric lifetimes and correspondingly low ODPs and GWPs, but also having chemical features that promote effectiveness (bromine and/or iodine) were arrived at:

1. Bromine-containing alkenes
2. Iodocarbons including iodine-containing alkanes and alkenes In general, these compounds are clean (they are gases or they evaporate without leaving a residue).

In a paper entitled "Beyond CFCs: Extending the Search for New Refrigerants," presented at the 1989 American Society of Heating Refrigerating and Air Conditioning Engineers CFC Technology Conference, William L. Kopko noted that the atmospheric lifetime of iodides "may be relatively short." However, he noted also that "iodine has some historic use in experiments where it prevented the formation of ozone in low level smog." He concluded that "These experiments indicate that iodine has at least some ozone depletion potential." This paper was presented at a conference on refrigeration and the comments were made in passing in a much larger paper on refrigerants.

In the Purdue University study (FIRE EXTINGUISHING AGENTS, Final Report, Purdue University, 1950) several iodine-containing agents and one alkene were looked at. However, no mention of atmospheric lifetime, global warming, or ozone depletion was made in the report.

Certain unsaturated halocarbons and iodides have also been mentioned as possible fire suppression agents in a report published by the National Institute of Standards and Technology (NIST Technical Note 1279, August 1990). This report gives scattered early references to flame inhibition by iodide compounds; however, with the exception of the paper by Sheinson, et al. (see below), none of these cites the application of these compounds as tropodegradable fire extinguishants, the major invention claimed here. It is interesting that the Dictionary of Organic Compounds, Volume 5, 5th Edition, Chapman and Hall, London, 1982, p. 5477, cites trifluoromethyl iodide as a "Fire-extinguishing agent"; however, no source for this is given. It is likely that this citation was made in error, confusing trifluoromethyl bromide with the iodide.

Trifluoromethyliodide was used in a study by Sheinson, et al., of the chemical parameters needed to extinguish fires (Fire Safety Journal, volume 15, 1989, pp. 437–450). This study was primarily to determine parameters needed to quantify fire suppressants and does not recommend iodides as fire extinguishants. The paper does point out, however, that if a way were found to decrease tropospheric lifetimes, replacements for ozone-depleting halons could be found. No method for decreasing tropospheric lifetimes is suggested or proposed, nor is the possibility of iodide tropodegradability mentioned.

None of the references cited above present information on methods of use, in particular, recommended agent concentrations for the methods of the present invention. Moreover, none of the references cited above discuss the method of use of halon replacements for explosion suppression and for inertion.

Accordingly, it is the object of the present invention to provide clean and effective fire extinguishing, fire suppression, explosion suppression, and explosion and fire inertion agents that contain, as principal components, chemicals that are rapidly destroyed or removed by natural processes in the troposphere. The term "agent" here means either a single compound or mixtures of two or more compounds. As a result of the rapid degradation in the troposphere or removal from the troposphere, the agent or principal components thereof will have very short atmospheric lifetimes, low ozone depletion potentials, and low global warming potentials. Our criterion is that the estimated atmospheric lifetime be on the order of days, giving ODPs and GWPs that approach zero (probably less than 0.02) for a ground-level release.

SUMMARY OF THE INVENTION

The present invention provides tropodegradable halocarbons having all of the desired properties for use as agents for fire extinguishing and suppression (in either total-flooding or streaming application), explosion suppression, and explosion and fire inertion. These compounds in accordance with the invention have the characteristics of cleanliness and high effectiveness against fires and explosions, but have short atmospheric lifetimes (on the order of days rather than years) resulting in low ODPs and GWPs. These chemicals are of two classes: (1) bromine-containing alkenes and (2) iodocarbons. The compounds of the present invention include bromine-containing alkenes and iodocarbons such as 3-bromo-3,3-difluoro-1-propene ($CH_2{=}CH{-}CF_2Br$); 2-bromo-3,3,3-trifluoro-1-propene ($CH_2{=}CBr{-}CF_3$); 1-bromo-3,3,3-trifluoro-propene ($BrCH{=}CH{-}CF_3$); 3-bromo-1,1,3,3-tetrafluoro-1-propene ($CF_2{=}CH{-}CF_2Br$); 2,3-dibromo-3,3-difluoro-1-propene ($CH_2{=}CBr{-}CBrF_2$); 1,2-dibromo-3,3,3-trifluoro-1-propene ($BrCH{=}CBr{-}CF_3$); 4-bromo-3,3,4,4-tetrafluoro-1-butene ($CH_2{=}CH{-}CF_2{-}CF_2Br$); 4-bromo-3-chloro-3,4,4-trifluoro-1-butene ($CH_2{=}CH{-}CClF{-}CF_2Br$); 4-bromo-3,4,4-trifluoro-3-trifluoromethyl-1-butene ($CH_2{=}CH{-}CF(CF_3){-}CBrF_2$); trifluoroiodomethane ($CF_3I$); difluoroiodomethane ($CHF_2I$); fluoroiodomethane ($CH_2FI$); difluorodiiodomethane ($CF_2I_2$); pentafluoroiodeethane ($CF_3CF_2I$); 1,1,2,2-tetrafluoro-1-iodoethane ($CF_2ICH_2F$); 1,1,2-trifluoro-1-iodoethane ($CF_2ICH_2F$); 1,1,2,2,3,3,3-heptafluoro-1-iodopropane ($CF_3CF_2CF_2I$), 1,1,1,2,3,3,3-heptafluoro-2-iodopropane ($CF_3CFICF_3$); 1,1,2,2,3,3,4,4,4-nonafluoro-1-iodobutane ($CF_3CF_2CF_2CF_2I$); 1,1,1,2,3,3-hexafluoro-3-iodo-2-(trifluoromethyl)propane ($CF_3CF(CF_3)CF_2I$); 1,1,1,3,3,1-hexafluoro-2-iodo-2-(trifluoromethyl) propane ($CF_3Cl(CF_3)CF_3$); 1,1,1,2,3,3,4,4,4-nonafluoro-2-iodobutane ($CF_3CFICF_2CF_3$); 1,1,2,2,3,3,4,4,5,5,5-undecafluoro-1-iodopentane ($CF_3CF_2CF_2CF_2CF_2I$); 1,1,2,2,3,3,4,4,5,5,6,6,6-tridecafluoro-1-iodohexane ($CF_3CF_2CF_2CF_2CF_2CF_2I$).

These and other aspects of the present invention will be more apparent upon consideration of the following detailed description of the invention.

DESCRIPTION OF PREFERRED EMBODIMENTS

Whereas the existing halons are known to have long atmospheric lifetimes, to contribute to the depletion of ozone in the stratosphere, and to contribute to global warming, the compounds of the present invention have low estimated atmospheric lifetimes (on the order of days, and well under a year) while containing chemical features that give a good efficiency for protection against fires and explosions. Here, a good efficiency means an efficiency predicted or known to be similar to that of the existing halons. The short atmospheric lifetime leads to low (near zero) stratospheric ozone depletion potentials and low (near zero) global warming potentials. Families of compounds with these characteristics are (1) bromine-containing alkenes and (2) iodocarbons. Examples of such compounds are set forth in Tables II and III below. Atmospheric lifetimes have not been rigorously calculated for most of these compounds. Alkenes are believed to be so rapidly destroyed by reaction with OH radicals in the troposphere that no calculations have been carried out. The atmospheric lifetimes are believed to be on the order of days, rather than years, and we have noted this by giving the estimated lifetimes for these compounds as approximately zero (~0) years in Table II. Very recently, a lifetime of less than 2 days was estimated by the National Oceanic and Space Administration for $CF_3I$ (unpublished). The lifetime of other iodides is expected to be no greater than that for $CF_3I$, either because they have a higher molecular weight (which slightly increases the probability of bond dissociation) or because they contain hydrogen (which provides a pathway for reaction with OH radicals). Therefore an estimated lifetime of less than two (<2) days is given for all iodides in Table III.

TABLE II

EXAMPLES OF BROMINE-CONTAINING ALKENES.

| Name | Formula | CAS No. | Boiling Point (°C.) | Estimated Lifetime (years) |
|---|---|---|---|---|
| 3-bromo-3,3-difluoro-1-propene | $CH_2{=}CH{-}CF_2Br$ | 420-90-6 | ‘42 | ~0 |
| 2-bromo-3,3,3-trifluoro-1-propene | $CH_2{=}CBr{-}CF_3$ | 1514-82-5 | 28 | ~0 |
| 1-bromo-3,3,3-trifluoro-1-propene | $BrCH{=}CH{-}CF_3$ | — | 40 | ~0 |
| 3-bromo-1,1,3,3-tetrafluoro-1-propene | $CF_2{=}CH{-}CF_2Br$ | 460-61-7 | 35 | ~0 |
| 2,3-dibromo-3,3-difluoro-1-propene | $CH_2{=}CBr{-}CBrF_2$ | — | 100 | ~0 |
| 1,2-dibromo-3,3,3-trifluoro-1-propene | $BrCH{=}CBr{-}CF_3$ | — | 96 | ~0 |
| 4-bromo-3,3,4,4-tetrafluoro-1-butene | $CH_2{=}CH{-}CF_2CF_2Br$ | 18599-22-9 | 55 | ~0 |
| 4-bromo-3-chloro-3,4,4-trifluoro-1-butene | $CH_2{=}CH{-}CClF{-}CF_2Br$ | 374-25-4 | 99 | ~0 |
| 4-bromo-3,4,4-trifluoro-3-(trifluoromethyl)-1-butene | $CH_2{=}CH{-}CF(CF_3){-}CBrF_2$ | 2546-54-5 | — | ~0 |

TABLE III

EXAMPLES OF IODOCARBONS.

| Name | Formula | CAS No. | Boiling Point (°C.) | Estimated Lifetime (years) |
|---|---|---|---|---|
| trifluoroiodomethane | $CF_3I$ | 2314-97-8 | −23 | <2 |
| difluoroiodomethane | $CHF_2I$ | 1493-03-4 | 22 | <2 |
| fluoroiodomethane | $CH_2FI$ | 373-53-5 | 53 | <2 |
| difluorodiiodomethane | $CF_2I_2$ | 1184-76-5 | 80 | <2 |
| pentafluoroiodoethane | $CF_3CF_2I$ | 354-64-3 | 12 | <2 |
| 1,1,2,2-tetrafluoro-1-iodoethane | $CF_2ICHF_2$ | 3831-49-0 | — | <2 |
| 1,1,2-trifluoro-1-iodoethane | $CF_2ICH_2F$ | 20705-05-9 | — | <2 |
| 1,1,2,2,3,3,3-heptafluoro-1-iodopropane | $CF_3CF_2CF_2I$ | 754-34-7 | 41 | <2 |
| 1,1,1,2,3,3,3-heptafluoro-2-iodopropane | $CF_3CFICF_3$ | 677-69-0 | 40 | <2 |
| 1,1,2,2,3,3,4,4,4-nonafluoro-1-iodobutane | $CF_3CF_2CF_2CF_2I$ | 423-39-2 | 67 | <2 |
| 1,1,1,2,3,3-hexafluoro-3-iodo-2-(trifluoromethyl)propane | $CF_3CF(CF_3)CF_2I$ | 1542-18-3 | — | <2 |
| 1,1,1,3,3,3-hexafluoro-2-iodo-2-(trifluoromethyl)propane | $CF_3CI(CF_3)CF_3$ | 4459-18-1 | — | <2 |
| 1,1,1,2,3,3,4,4,4-nonafluoro-2-iodobutane | $CF_3CFICF_2CF_3$ | 375-51-9 | — | <2 |
| 1,1,2,2,3,3,4,4,5,5,5-undecafluoro-1-iodopentane | $CF_3CF_2CF_2CF_2CF_2I$ | 638-79-9 | — | <2 |
| 1,1,2,2,3,3,4,4,5,5,6,6,6-tridecafluoro-1-iodohexane | $CF_3CF_2CF_2CF_2CF_2CF_2I$ | 355-43-1 | 117 | <2 |

The methods of use disclosed herein present concentration ranges required for total-flood suppression and extinguishment of fires, for explosion suppression, and for inertion. These are ranges of average concentrations achieved for any period of time following discharge of the agent, recognizing that concentrations may change with time owing to such factors as leakage from the protected space or area and that concentrations may exhibit spatial variations owing to incomplete mixing. Depending on the space or area protected, additional amounts of agent may have to be introduced because of leakage or diffusion in order to achieve the proper final concentration at some stage of the operation. Concentration requirements are not normally specified for streaming agents.

The cup burner is a widely accepted laboratory test apparatus for determining the fire extinguishing and suppressing effectiveness of agents. In this method, an agent is introduced into a stream of air which passes around a cup of burning liquid fuel, and the concentration of gaseous agent needed to extinguish the flame is determined. During this operation, any agent that is normally a liquid is allowed to become a gas before being mixed into the stream of air and passed by the burning liquid fuel. The cup burner is so widely accepted that the National Fire Protection Association (NFPA) Standard 2001 on Clean Agent Fire Extinguishing Systems mandates this method as the primary procedure for determining the concentration needed to extinguish a fire of liquid hydrocarbon fuels (e.g., gasoline, hexane, etc. Such fires are termed "Class B fires"). That standard states that "The minimum design concentration for Class B flammable liquids shall be a demonstrated extinguishing concentration plus a 20 percent safety factor. Extinguishing concentration shall be demonstrated by the cup burner test." Concentrations are usually expressed as "percent by volume." This is the same as the "percent by gas volume," which is calculated assuming that all of the introduced agent has volatilized (i.e., vaporized to become a gas). Testing by our organization indicates that a 40 percent increase may be a better safety margin for some chemical agents. Cup burner tests have been conducted for members of both the bromoalkene and the iodocarbon groups. A selection of the results obtained are presented in the examples (see in particular, Tables IV and V). Taking into account the range of cup burner values determined for the various tropodegradable agents with varying fuels and allowing for safety factors of up to 40 percent, we calculate a design concentration range for total-flood fire suppression and extinguishment of Class B fires by bromoalkenes and iodocarbons of 1 to 12 percent by gas volume. Class A fires (fires of solid fuels such as paper and wood) may require a higher extinguishment concentration; however, limited work on such fires with halocarbon extinguishing and suppressing agents indicates that the 40 percent safety margin will include the required range for these fires as well.

Inerting concentrations are usually measured using a Spherical Test Vessel and an electric discharge inertion source as described in NFPA Standard 2001. This standard states that "The minimum design concentrations used to inert atmospheres involving flammable liquids and gases shall be determined by test plus a 10 percent safety factor." Data from our laboratory for a large number of halocarbons shows that, on an average, inertion of a space filled with propane or methane requires an inertion concentration of up to 2.07 times the concentration required for extinguishment of an n-heptane fire in a cup burner by the same agent. Taking this into account and using cup burner data determined for tropodegradable compounds, we calculate a design concentration range for inertion by bromoalkenes and iodocarbons of 1 to 13 percent by gas volume. This range was confirmed with limited Spherical Test Vessel inertion data for tropodegradable compounds. The maximum in this range was determined using a safety margin of up to 40 percent (to allow for inherent experimental scatter in inertion and fire extinguishment and suppression testing). The minimum value was calculated assuming no increase over the n-heptane cup burner concentration and allowing for experimental data scatter.

Our testing indicates that explosion suppression may be determined a much by physical heat absorption as by chemical free radical chain disruption. In many cases, concentrations much higher than the extinguishment concentrations determined by the cup burner method are required to (1) rapidly suppress an expanding fireball and (2) to allow for leakage from the space protected. For example, testing has shown that up to seven times the cup burner concentration may be required depending on the threat. Based on this information, we calculate a concentration range required for explosion suppression by bromoalkenes and iodocarbons of 2 to 50 percent allowing for a 60 percent safety margin. The allowed safety margin is higher than for protection of most other hazards due to the large threat imposed by explosions.

A halocarbon carrier may be added to one or more of the tropodegradable compounds to aid in distribution of the agent, to modify the physical properties, or to provide other benefits. Mixtures of halocarbon carriers with tropodegradable compounds may be either azeotropes, which do not change in composition as they evaporate, or zeotropes, which do change in composition during evaporation (more volatile components tend to evaporate preferentially). Mixtures that change only slightly in composition during evaporation are sometimes termed "near azeotropes." In some cases, there are advantages to azeotropes and near azeotropes. Mixtures covered by this application include azeotropes, near azeotropes, and zeotropes.

Carriers can be materials such as hydrochlorofluorocarbons, hydrofluorocarbons, or perfluorocarbons. Hydrochlorofluorocarbons (HCFCs) are chemicals containing only hydrogen, chlorine, fluorine, and carbon. Examples of HCFCs that could be used as carriers are 2,2-dichloro-1,1,1-trifluoroethane ($CHCl_2CF_3$), chlorodifluoromethane ($CHClF_2$), 2-chloro-, 1,1,1,2-tetrafluoroethane ($CHClFCF_3$), and 1-chloro-1,1-difluoroethane ($CH_3CClF_2$). Hydrofluorocarbons (HFCs) are chemicals containing only hydrogen, fluorine, and carbon. Examples of potential HFC carriers are trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), and 1,1,1,4,4,4-hexafluorobutane ($CF_3CH_2CH_2CF_3$). Perfluorocarbons, which contain only fluorine and carbon, are characterized by very low toxicities. Examples of perfluorocarbons that could be used as carriers are tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), and perfluoromethyldecalin ($C_{10}F_{17}CF_3$). Although these carriers may make some contribution to ozone depletion and/or global warming, the presence of the tropodegradable components decreases the overall environmental impact while increasing the fire and explosion protection of the mixture compared to the pure carrier. In some cases, the advantages gained by using either an azeotropic or a zeotropic mixture of one or more tropodegradable agents combined with one or more other halocarbons as carriers may offset environmental consequences. Our work indicates that some mixtures of two or more halocarbons possess flame extinguishment and suppression ability greater than would be predicted from the intrinsic fire suppression ability of the separate components, a phenomenon that we term "synergism." Note that it is not necessary that the carrier have zero flammability. It is only necessary that the mixture of carrier (s) and tropodegradable agent(s) act as a fire and/or explosion protection agent.

The embodiments include the use of agents comprised of bromine-containing alkenes and/or comprised of iodocarbons, with or without carriers, for the four applications of fire extinguishment or suppression using a total-flood application, fire extinguishment or suppression using a streaming application, explosion suppression, and inertion against fires and explosions.

The following examples illustrate the fire and explosion protection and the environmental capabilities of agents in accordance with the invention.

EXAMPLE 1

Into a flowing air stream in which a cup of burning n-heptane fuel is contained was introduced a quantity of 1,1,2,2,3,3,4,4,4-nonafluoro-1-iodobutane ($CF_3CF_2CF_2CF_2I$) sufficient to raise the concentration to 2.8 percent agent by gas volume. The fire was immediately extinguished and no agent solid or liquid agent residue remained. This concentration of agent was 87 percent as much as required to extinguish the same fire using Halon 1211 (which required a concentration of 3.2 percent) and it is 97 percent as much as required to extinguish the same fire using Halon 1301 (which required a concentration of 2.9 percent). The stratospheric ozone depletion resulting from this process was essentially zero. The portion of the agent that underwent combustion or pyrolysis formed HI, HF, and other products that are all water soluble and are washed out in rainfall before reaching the stratosphere. Most of the portion of the agent that did not react in the fire undergoes photolysis and reaction with hydroxyl radicals in the troposphere, forming water-soluble products which are washed out in rainfall and do not reach the stratosphere. Ultimately when these products reach the earth's surface, the degradable products of the agent form harmless salts such as NaF and NaI. Results of similar experiments using a cup burner with other tropodegradable compounds are shown in Table IV. In addition, cup burner data for $CF_3I$ with a variety of fuels are given in Table V.

TABLE IV

ADDITIONAL RESULTS FOR EXAMPLE I (n-HEPTANE FUEL).

| Name | Formula | CAS No. | Extinguishment Concentration, % by volume |
|---|---|---|---|
| trifluoroiodomethane | $CF_3I$ | 2314-97-8 | 3.0 |
| pentafluoroiodoethane | $CF_3CF_2I$ | 354-64-3 | 2.1 |
| 1,1,2,2,3,3,3-heptafluoro-1-iodopropane | $CF_3CF_2CF_2I$ | 754-34-7 | 3.0 |
| 4-bromo-3,3,4,4-tetrafluoro-1-butene | $CH_2{=}CH{-}CF_2CF_2Br$ | 18599-22-9 | 3.5 |
| 4-bromo-3-chloro-3,4,4-trifluoro-1-butene | $CH_2{=}CH{-}CClF{-}CF_2Br$ | 374-25-4 | 4.5 |
| 1,1,1,2,3,3,3-heptafluoro-2-iodopropane | $CF_3CFICF_3$ | 677-69-0 | 3.2 |
| 1,1,2,2,3,3,4,4,5,5,6,6,6-tridecafluoro-1-iodohexane | $CF_3CF_2CF_2CF_2CF_2CF_2I$ | 355-43-1 | 2.5 |

TABLE V

ADDITIONAL RESULTS FOR EXAMPLE 1: $CF_3I$ WITH A VARIETY OF FUELS.

| Fuel | Extinguishment Concentration, % by volume |
|---|---|
| Acetonitrile | 1.70 |
| 1-Butanol | 3.29 |
| n-Butyl Acetate | 2.52 |
| Diesel #2 | 3.26 |
| Ethane | 3.37 |
| Ethanol (Absolute) | 2.99 |
| Ethyl Acetate | 2.99 |
| Ethylene Glycol | 2.37 |
| Gasoline, Aviation | 3.66 |
| Gasoline, Unleaded | 3.60 |
| Heptane | 3.05 |
| Hydraulic Fluid #1 | 2.34 |
| JP-4 Fuel | 3.29 |
| JP-5 Fuel | 3.23 |
| Methanol | 3.75 |
| Methyl Ethyl Ketone | 4.36 |
| Methyl Isobutyl Ketone | 2.88 |
| Nitromethane | 2.22 |
| Pyrrolidine | 2.79 |
| Turbo Hydraulic Oil 2380 | 2.07 |
| Xylene | 5.52 |

EXAMPLE 2

Into a 7930 cubic-centimeter volume containing a stiochiometric explosive and flammable mixture of methane fuel and air, a quantity of trifluoroiodomethane ($CF_3I$) was added sufficient to raise the concentration to 3.1 percent agent by gas volume. A spark discharge of 70 Joules was used to ignite the mixture. However, with the addition of the trifluoroiodomethane ($CF_3I$) at the concentration of 3.1 percent the mixture did not ignite. During this same process, it required 4.3 percent Halon 1301 to prevent the ignition of the stiochiometric, explosive flammable mixture of methane fuel and air. Therefore, approximately a 28 percent lower concentration of trifluoroiodomethane ($CF_3I$) was needed on a volume basis to prevent the explosion than was required for Halon 1301. Virtually no stratospheric ozone depletion or global warming results from release of trifluoroiodomethane ($CF_3I$) owing to its extremely short atmospheric lifetime. This illustrates the use of trifluoroiodomethane ($CF_3I$) to inert a space containing a flammable and explosive atmosphere.

EXAMPLE 3

Into a simulator of the engine compartment of an MI U.S. Army Tactical Vehicle (U.S. Army "Tank"), 2.69 pounds of trifluoroiodomethane ($CF_3I$) was discharged into a space containing a spray of ignited Jet A fuel. The fire was extinguished in 1.20 seconds. A second test required 3.04 pounds of Halon 1301 to give an extinguishment time of 1.30 seconds. Therefore, the trifluoroiodomethane ($CF_3I$) gave a decreased time to extinguishment and required less agent than required for an extinguishment with Halon 1301. The atmospheric lifetime, global warming, and ozone depletion produced by excess emissions of trifluoroiodomethane ($CF_3I$) were essentially zero. In a third test under the same conditions, 2.51 pounds of Halon 1301 failed to extinguish the fire. This illustrates the application of a tropodegradable iodocarbon to extinguish a simulated engine compartment fire.

EXAMPLE 4

Into a 7930 cubic-centimeter volume containing a stiochiometric, explosive and flammable mixture of methane fuel and air, a quantity of a mixture containing 85 percent 1,1,1,2-tetrafluoroethane ($CH_2FCF_3$) and 15 percent trifluoroiodomethane ($CF_3I$) was added sufficient to raise the concentration to 5.1 percent of the mixed agent by gas volume. A spark discharge of 70 Joules was used to try to ignite the mixture. However, with the addition of the mixture of 85 percent 1,1,1,2-tetrafluoroethane ($CH_2FCF_3$) and 15 percent trifluoroiodomethane ($CF_3I$) at the concentration of 5.1 percent the mixture did not ignite. During this same process, it required 7.8 percent of the pure 1,1,1,2-tetrafluoroethane ($CH_2FCF_3$) carrier to prevent the ignition of the stiochiometric, explosive flammable mixture of methane fuel and air. Therefore, a 27 percent lower concentration of the tetrafluoroethane ($CH_2FCF_3$) and trifluoroiodomethane ($CF_3I$) mixture was needed on a volume basis to prevent the explosion than was needed for pure 1,1,1,2-tetrafluoroethane ($CH_2FCF_3$) carrier. The mixture has a decreased atmospheric lifetime and global warming potential relative to the pure carrier owing to the extremely short atmospheric lifetime of the trifluoroiodomethane ($CF_3I$). Moreover, even with the addition of only 15 percent trifluoroiodomethane ($CF_3I$) in the mixture, the amount required to inert the space is greatly decreased compared to the pure 1,1,1,2-tetrafluoroethane ($CH_2FCF_3$) carrier. This illustrates the use of a mixture of the tropodegradable agent trifluoroiodomethane ($CF_3I$) and the carrier 1,1,1,2-tetrafluoroethane ($CH_2FCF_3$) to inert a space.

EXAMPLE 5

Into a 645 cubic foot chamber containing a 0.4-square-foot pan of burning n-heptane fuel, sufficient trifluoroiodomethane ($CF_3I$) was discharged to provide a resulting concentration of 2.6 percent by gas volume. The fire was extinguished in 2 seconds. In a second experiment using the same apparatus and fire size, Halon 1301 was discharged to give a resulting concentration of 3.8 percent by gas volume. The fire was extinguished in 22.0 seconds. Thus, at a concentration 40 percent lower than that used for Halon 1301, trifluoroiodomethane ($CF_3I$) extinguished an n-heptane fire in a time that was 9 percent of that required for Halon 1301. This illustrates the use of a tropodegradable agent to extinguish fires in a large, enclosed space by total flooding.

The present invention has been described and illustrated with reference to certain preferred embodiments. Nevertheless, it will be understood that various modifications, alterations and substitutions may be apparent to one of ordinary skill in the art, and that such modifications, alterations and substitutions may be made without departing from the essential invention. Accordingly, the present invention is defined only by the following claims.

We claim:

1. The method of extinguishing or suppressing a fire in a total-flood application, said method comprising the steps of a) providing an agent characterized by a low atmospheric lifetime, a low ozone depletion potential, and a low global warming potential, with said agent containing at least one compound selected from the group consisting of bromine-containing alkenes, b) disposing said agent in a pressurized discharge system, and c) discharging said agent into an area to provide an average resulting concentration in said area of between 1 and 12 percent by gas volume to extinguish or suppress fires in that area.

2. The method of claim 1 wherein said agent comprises at least one bromine-containing alkene containing one or more bromine atoms and up to six carbon atoms, the remaining atoms being selected from the group consisting of hydrogen, chlorine and fluorine atoms.

3. The method of claim 2 wherein said at least one haloalkene is selected from the group consisting of 3-bromo-3,3-difluoro-1-propene ($CH_2{=}CH{-}CF_2Br$); 2-bromo-3,3,3-trifluoro-1-propene ($CH_2{=}CBr{-}CF_3$); 1-bromo-3,3,3-trifluoro-1-propene ($BrCH{=}CH{-}CF_3$); 3-bromo-1,1,3,3-tetrafluoro-1-propene ($CF_2{=}CH{-}CF_2Br$); 2,3-dibromo-3,3-difluoro-1-propene ($CH_2{=}CBr{-}CBrF_2$); 1,2-dibromo-3,3,3-trifluoro-1-propene ($BrCH{=}CBr{-}CF_3$), 4-bromo-3,3,4,4-tetrafluoro-1-butene ($CH_2{=}CH{-}CF_2{-}CF_2Br$); 4-bromo-3-chloro-3,4,4-trifluoro-1-butene ($CH_2{=}CH{-}CClF{-}CF_2Br$); 4-bromo-3,4,4-trifluoro-3-trifluoromethyl-1-butene ($CH_2{=}CH{-}CF(CF_3){-}CBrF_2$).

4. The method of claim 1 which includes the step of adding to said agent a carrier comprised of one or more halocarbons other than bromine-containing alkenes or iodocarbons.

5. The method of claim 4 wherein said at least one halocarbon is selected from the group consisting of hydrochlorofluorocarbons, hydrofluorocarbons, and perfluorocarbons.

6. The method of claim 5 wherein said hydrochlorofluorocarbons, hydrofluorocarbons, and perfluorocarbons each contain 1 through 10 carbon atoms.

7. The method of claim 6 wherein said at least one halocarbon is selected from the group consisting of 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), 1-chloro-1, 1-difluoroethane ($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$); 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), 1,1,1,4,4,4-hexafluorobutane ($CF_3CH_2CH_2CF_3$), tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), and perfluoromethyldecalin ($C_{10}F_{17}CF_3$).

8. The method of extinguishing or suppressing a fire in a streaming application, said method comprising the steps of a) providing an agent characterized by a low atmospheric lifetime, a low ozone depletion potential, and a low global warming potential, with said agent containing at least one compound selected from the group consisting of bromine-containing alkenes, b) disposing said agent in a pressurized discharge system, and c) discharging said agent from said system toward an existing fire to suppress or extinguish said fire.

9. The method of claim 8 wherein said agent comprises at least one bromine-containing alkene containing one or more bromine atoms up one to six carbon atoms, the remaining atoms being selected from the group consisting of hydrogen chlorine and fluorine atoms.

10. The method of claim 9 wherein said at least one haloalkene is selected from the group consisting of 3-bromo-3,3-difluoro-1-propene ($CH_2{=}CH{-}CF_2Br$); 2-bromo-3,3,3-trifluoro-1-propene ($CH_2{=}CBr{-}CF_3$); 1-bromo-3,3,3-trifluoro-1-propene ($BrCH{=}CH{-}CF_3$); 3-bromo-1,1,3,3-tetrafluoro-1-propene ($CF_2{=}CH{-}CF_2Br$); 2,3-dibromo-3,3-difluoro-1-propene ($CH_2{=}CBr{-}CBrF_2$); 1,2-dibromo-3,3,3-trifluoro-1-propene ($BrCH{=}CBr{-}CF_3$), 4-bromo-3,3,4,4-tetrafluoro-1-butene ($CH_2{=}CH{-}CF_2{-}CF_2Br$); 4-bromo-3-chloro-3,4,4-trifluoro-1-butene ($CH_2{=}CH{-}CClF{-}CF_2Br$); 4-bromo-3,4,4-trifluoro-3-trifluoromethyl-1-butene ($CH_2{=}CH{-}CF(CF_3)$-$CBrF_2$).

11. The method of claim 8 which includes the step of adding to said agent a carrier comprised of one or more halocarbons other than bromine-containing alkenes or iodocarbons.

12. The method of claim 11 wherein said at least one halocarbon is selected from the group consisting of hydrochlorofluorocarbons, hydrofluorocarbons, and perfluorocarbons.

13. The method of claim 12 wherein said hydrochlorofluorocarbons, hydrofluorocarbons, and perfluorocarbons each contain 1 through 10 carbon atoms.

14. The method of claim 13 wherein said at least one halocarbon is selected from the group consisting of 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), 1-chloro-1,1-difluoroethane ($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2{-}F_2H$), 1,1,1,2,3,3,3-heptafluoropropane ($CF_3CHFCF_3$), 1,1,1,4,4,4-hexafluorobutane ($CF_3CH_2CH_2CF_4$), tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), and perfluoromethyldecalin ($C_{10}F_{17}CF_3$).

15. The method of suppressing an explosion with an agent, said method comprising the steps of a) providing an agent characterized by a low atmospheric lifetime, a low ozone depletion potential, and a low global warming potential, with said agent containing at least one compound selected from the group consisting of bromine-containing alkenes, b) disposing said agent in a pressurized discharge system, and c) detecting an explosion and discharging said agent into the area of the explosion to provide an average resulting concentration between 2 and 50 percent by gas volume to suppress the explosion.

16. The method of claim 15 wherein said agent comprises at least one bromine-containing alkene containing one or more bromine atoms and up to six carbon atoms, the remaining atoms being selected from the group consisting of hydrogen chlorine and fluorine atoms.

17. The method of claim 16 wherein said at least one haloalkene is selected from the group consisting of 3-bromo-3,3-difluoro-1-propene ($CH_2{=}CH{-}CF_2Br$); 2-bromo-3,3,3-trifluoro-1-propene ($CH_2{=}CBr{-}CF_3$); 1-bromo-3,3,3-trifluoro-1-propene ($BrCH{=}CH{-}CF_3$); 3-bromo-1,1,3,3-tetrafluoro-1-propene ($CF_2{=}CH{-}CF_2Br$); 2,3-dibromo-3,3-difluoro-1-propene ($CH_2{=}CBr{-}CBrF_2$); 1,2-dibromo-3,3,3-trifluoro-1-propene ($BrCH{=}CBr{-}CF_3$); 4-bromo-3,3,4,4-tetrafluoro-1-butene ($CH_2{=}CH{-}CF_2{-}CF_2Br$); 4-bromo-3-chloro-3,4,4-trifluoro-1-butene ($CH_2{=}CH{-}CClF{-}CF_2Br$); 4-bromo-3,4,4-trifluoro-3-trifluoromethyl-1-butene ($CH_2{=}CH{-}CF(CF_3)$-$CBrF_2$).

18. The method of claim 15 which includes the step of adding to said agent a carrier comprised of one or more halocarbons other than bromine-containing alkenes or iodocarbons.

19. The method of claim 18 wherein said at least one halocarbon is selected from the group consisting of hydrochlorofluorocarbons, hydrofluorocarbons, and perfluorocarbons.

20. The method of claim 19 wherein said hydrochlorofluorocarbons, hydrofluorocarbons, and perfluorocarbons each contain 1 through 10 carbon atoms.

21. The method of claim 20, wherein said at least one halocarbon is selected from the group consisting of 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), 1-chloro-1,1-difluoroethane ($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), 1,1,1,4,4,4-hexafluorobutane ($CF_3CH_2CH_2CF_3$), tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), and perfluoromethyldecalin ($C_{10}F_{17}CF_3$).

22. The method of inerting an area to prevent a fire or explosion, said method comprising the steps of a) providing an agent characterized by a low atmospheric lifetime, a low ozone depletion potential, and a low global warming potential, with said agent containing at least one compound selected from the group consisting of bromine-containing alkenes, b) disposing said agent in a pressurized discharge system, and c) discharging said agent into said area to provide an average resulting concentration between 1 and 13 percent by gas volume to prevent a fire or an explosion from occurring.

23. The method of claim 22 wherein said agent comprises at least one bromine-containing alkene containing one or more bromine atoms and up to six carbon atoms, the remaining atoms being selected from the group consisting of hydrogen, chlorine and fluorine atoms.

24. The method of claim 23 wherein said at least one haloalkene is selected from the group consisting of 3-bromo-3,3-difluoro-1-propene ($CH_2{=}CH{-}CF_2Br$); 2-bromo-3,3,3-trifluoro-1-propene ($CH_2{=}CBr{-}CF_3$); 1-bromo-3,3,3-trifluoro-1-propene ($BrCH{=}CH{-}CF_3$); 3-bromo-1,1,3,3-tetrafluoro-1-propene ($CF_2{=}CH{-}CF_2Br$); 2,3-dibromo-3,3-difluoro-1-propene ($CH_2{=}CBr{-}CBrF_2$); 1,2-dibromo-3,3,3-trifluoro-1-propene ($BrCH{=}CBr{-}CF_3$); 4-bromo-3,3,4,4-tetrafluoro-1-butene ($CH_2{=}CH{-}CF_2{-}CF_2Br$); 4-bromo-3-chloro-3,4,4-trifluoro-1-butene ($CH_2{=}CH{-}CClF{-}CF_2Br$); 4-bromo-3,4,4-trifluoro-3-trifluoromethyl-1-butene ($CH_2{=}CH{-}CF(CF_3){-}CBrF2$).

25. The method of claim 22 which includes the step of adding to said agent a carrier comprised of one or more halocarbons other than bromine-containing alkenes or iodocarbons.

26. The method of claim 25 wherein said at least one halocarbon is selected from the group consisting of hydrochlorofluorocarbons, hydrofluorocarbons, and perfluorocarbons.

27. The method of claim 26 wherein said hydrochlorofluorocarbons, hydrofluorocarbons, and perfluorocarbons each contain 1 through 10 carbon atoms.

28. The method of claim 27 wherein said at least one halocarbon is selected from the group consisting of 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), 1-chloro-1,1-difluoroethane (($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), 1,1,1,4,4,4-hexafluorobutane ($CF_3CH_2CH_2CF_3$), tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), and perfluoromethyldecalin ($C_{10}F_{17}CF_3$).

* * * * *